US006137040A

United States Patent [19]

Hoshino

[11] Patent Number: 6,137,040

[45] Date of Patent: Oct. 24, 2000

[54] SPRING STRUCTURE FOR A DRUM PEDAL

[75] Inventor: Yoshihiro Hoshino, Moriyama Ku, Japan

[73] Assignee: Hoshino Gakki Co., Ltd., Japan

[21] Appl. No.: 09/150,656

[22] Filed: Sep. 10, 1998

[30] Foreign Application Priority Data

Jan. 21, 1998 [JP] Japan ..... 10-025050

[51] Int. Cl.[7] ..... G10D 13/02

[52] U.S. Cl. ..... 84/422.1; 84/422.2; 84/422.3

[58] Field of Search ..... 84/422.1, 422.2, 84/422.3

[56] References Cited

U.S. PATENT DOCUMENTS

| | | | |
|---|---|---|---|
| 4,890,532 | 1/1990 | Carlson | 84/422.1 |
| 5,301,592 | 4/1994 | Johnston | 84/422.1 |
| 5,317,946 | 6/1994 | Hoshino | 84/422.1 |
| 5,574,237 | 11/1996 | Yanagisawa | 84/422.1 |
| 5,773,736 | 6/1998 | Hsieh | 84/422.1 |

*Primary Examiner*—David Martin
*Assistant Examiner*—Kim Lockett
*Attorney, Agent, or Firm*—Ostrolenk, Faber, Gerb & Soffen, LLP

[57] ABSTRACT

A spring and support structure connected through a cam with a rotary shaft for urging the rotary shaft toward a first rotation orientation. The spring urging the shaft to return toward the first rotation orientation when the shaft is rotated off that first orientation. A cam is affixed to and rotates with the shaft. A spring support is pivotally connected to the cam at a bearing between them. A spring extends between the spring support and a support base for urging the shaft and the cam toward the first orientation. The spring support includes a window larger in size than the bearing. The window periphery having an insertion groove in which the bearing sits. The bearing is easily insertable into the window and removable therefrom due to the window size. The spring support is comprised of an inside and outside member which have openings facing in opposite circumferential directions. The spring is hooked in the combined openings and is held there by the arrangement of the inside and outside parts of the spring support.

6 Claims, 11 Drawing Sheets

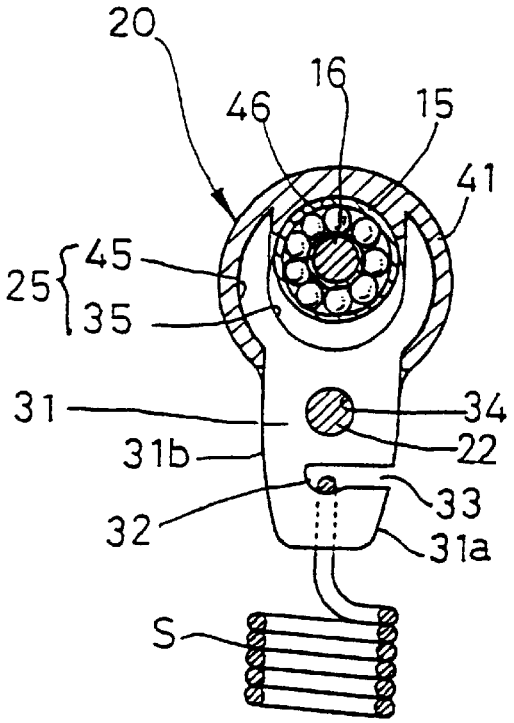
FIG. 3
FIG. 6
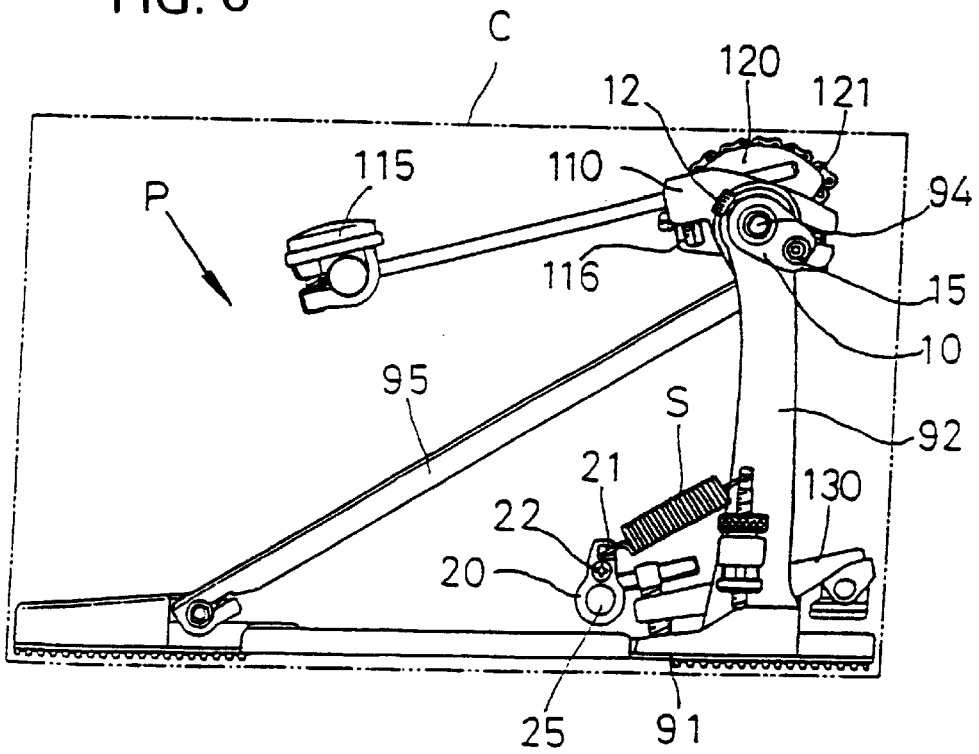

SPRING STRUCTURE FOR A DRUM PEDAL

BACKGROUND OF THE INVENTION

The invention relates to a spring structure for a drum pedal.

A bass drum of prior art design is shown in FIGS. 9–13. It includes supports 92 which extend up from both lateral sides of a base 91 of a drum pedal 90. A beater rotary shaft 94 is held freely rotatably in bearings 93 at the top ends of the supports 92. At the approximate center of the beater rotary shaft 94, there is a beater member 110 on the shaft and a wheel shaped operating member 120 that rotates integrally with the beater member 110. A beater 115 is fixed on the beater member 110 by the screws 116.

The operating member 120 comprises a sprocket or a partial sprocket, having a toothed periphery on which a chain 121 is wound. One end of the chain is fixed to the operating member 120. The other end of the chain 121 is linked to the tip of a swingable foot pedal 95, which has a rear end that is pivoted to a platform or pedal base. The chain 121 is pulled down as the foot pedal 95 is stepped on, as shown by arrow A in FIG. 9. This rotates the operating member 120, which rotates the beater member 110 so that the beater 115 beats the drum surface D.

FIG. 11 shows a cam 100 which is fixed by a screw 101 at the edge of the beater rotary shaft 94. There is a shaft receiving hole 102 approximately at the center of cam 100, through which the rotary shaft 94 is inserted. A plurality of roller holes 103 are formed at circumferentially closely spaced intervals in the cam 100.

A roller installation bolt 104 is screwed into a selected one of the roller installation holes 103. A generally ring shaped spring 106 extends around a roller 105 that is installed in the roller installation bolt 104. The top end of a coil spring 107 is attached at the bottom tip of the spring 106. The lower end of the spring 107 is attached on the lower bracket 109 outside the support 92.

The spring 107 automatically restores the beater rotary shaft 94, returning the beater 115 automatically to its original position off the drum surface after it beats the drum surface D. A bearing holder 93*a* holds the bearing 93 on the shaft 94. An adjusting bolt at the bottom of the spring 107 adjusts the tension of the spring 107. There is a clamp 130 for holding the drum hoop.

In the spring structure, the roller 105 rotates with respect to the roller installation bolt 104 when the cam 100 rotates during beating of the drum surface D. At this juncture, the downward pull of the tension spring 107 pulls the roller 105 downward producing friction between the inner surface of the roller 105 and the outer surface of the roller installation bolt 104. This friction prevents rotation of the roller 105 so that the smooth swinging of the beater 115 becomes difficult.

Moreover, the spring 106 can be detached from the roller 105 by hand for convenience at the time of transportation, etc. As the top of the spring 107 goes through the gap G in the spring 106, however, the spring 106 may separate from the spring 107.

If the gap G of the spring 106 is made smaller to prevent the possible loss of the spring 106 through falling out, then production and assembly become more difficult.

Those members in FIG. 12 which are the same as in FIGS. 9 through 11 have the same reference numbers. To avoid the above described situation, FIG. 12 shows a design with a hole 141 at the lower part of the cam 140, with a bearing 145 arranged in the hole 141. The installation part of the spring member 150 has a groove 151 that receives a narrowed lower part of the cam 140 so that they are freely rotatably held together. The top of the spring 153 can be hooked at the opening 152 in the lower part of the spring member 150.

A spring member 150 is installed on the cam 140 through a bearing 145. Therefore, the friction experienced during rotation of the spring member 150 with respect to the cam 140 is reduced, thereby enabling the beater rotary shaft 94 to be smoothly rotated. Also, the spring 153 cannot disengage from the spring member 150.

The spring member 150 is installed on the bearing 145 of the cam member 140 through tightening of the installation bolt 155. This makes it difficult to easily remove the spring member 150 from the cam 140. As a consequence, when the beater is transported, it may be transported either as it is or in the state where the beater 115 is situated above the support 92 or the operating member 120 or when the beater 115 has been removed from the beater member 110.

If the drum pedal is to be carried as it is, the drum pedal cannot be carried in a case but has to be carried without packaging. This requires special care to avoid damaging the drum pedal when it is transported.

When the drum pedal is to be transported by removing the beater 115 from the beater member 110, moreover, the screws 116 are tightened or loosened for attaching or detaching the beater 115, which requires a turning key. At the same time, to assure reproducibility, it is necessary to memorize the installation position or orientation of the beater 115 relative to the beater member 110.

But once the drum pedal 90 has been separated into the beater 115 and its other members, it is likely that the beater 115 or the screws 116, which have been loosened and are in a free state, etc. will be lost. If the spring member 150 can be detached from the cam 140, it is convenient for transportation because the drum pedal can be accommodated in a case, provided that the beater 115 is positioned below the operating member 120 or the support. This makes a turning key unnecessary and affords little possibility for the members to be lost.

In FIG. 13, parts which are the same as in FIGS. 9 through 11 have the same reference numbers. The bearing 162 is enclosed in the roller installation hole 161 of the cam member 160. The roller 163 has a hanging part 164 that is freely rotatable on the cam member 160 through the bearing 162. The ring shaped spring member 165 is hung at the hanging part 164 of the roller 163 to provide a spring through the spring member 165.

A washer 166 is held by a tightening nut 167 for the roller 163. The bearing 162 is held in a bearing holder 168. A tightening screw 169 holds the bearing holder 168.

In the structure of FIG. 13, the tension of the spring 107 is added to the hanging part 164 of the roller 163 by the bearing 162, which prevents rotation of the roller 163 with respect to the cam member 160. As the spring member 165 can be detached from the roller 163, moreover, the beater can be located below the support or the operating member, making it easier to transport the drum pedal.

The above described structure, however, applies an excessive load to the bearing 162. This produces inconvenience in the rotation of the roller 163 with respect to the cam member 160 and induces trouble in the bearing 162 or the roller 163, in some cases because the bearing 162 and the spring member 165 are arranged in parallel.

SUMMARY OF THE INVENTION

This invention has the object of overcoming the above described circumstances.

The invention provides a spring structure for a drum pedal, in which rotation of the beater rotary shaft is made smooth. At the same time, the spring can be easily detached from its support.

A spring structure is connected through a cam with a rotary shaft for urging the rotary shaft toward a first rotation orientation. The spring urges the shaft to return toward the first rotation orientation when the shaft is rotated off that first orientation. The cam is affixed to and rotates with the shaft. A spring support is pivotally connected to the cam at a bearing between them. The spring extends between the spring support and a support base for urging the shaft and the cam toward the first orientation. The spring support includes a window larger in size than the bearing and the window has an insertion groove at its periphery in which the bearing sits. The bearing is easily insertable into and removable from the window due to the enlarged window size. Further, the spring support is comprised of an inside and outside member which have openings that face in opposite circumferential directions. The spring is held in the combined openings by the arrangement of the inside and outside parts of the spring support.

The spring structure is used for a drum pedal having a beater rotary shaft that is freely rotatably held on a support. The spring extends between a cam which is provided at one end of the beater rotary shaft and the lower part of the support. The bearing protrudes outside the cam. The spring includes a spring part that hooks the spring at the bottom of that cam with reference to the bearing. The spring support has a window which is larger than the outside periphery of the bearing in the window. An engagement groove engages the upper part of the bearing at the top edge of the said window part whereby the bearing is freely insertable in and removable from the window.

Moreover, the invention relates to a spring structure for a drum pedal wherein the spring support comprised of an inside member and an outside member. The spring support includes a spring insertion opening and the inside member and the outside member may be arranged to face in opposite directions to retain the spring hooked in the openings.

Other objects and features of the invention are explained below with reference to the attached drawings.

BRIEF DESCRIPTION OF THE DRAWINGS

FIG. 3 is a side cross section along line 3—3 in FIG. 2.

FIGS. 4A–F show an inside member of the spring member, wherein FIG. 4A is a front view of the inside member 31, FIG. 4B shows the back side of the inside member 31, FIG. 4C shows the side of the inside member 31, FIG. 4D shows the upper surface of the inside member 31, FIG. 4E is a cross section cut along line a—a in FIG. 4A, and FIG. 4F is a cross section cut along line b—b in FIG. 4A.

FIGS. 5A–E show an outside member of the spring member, wherein FIG. 5A is a front view of the outside member 41, FIG. 5B is a rear view of the outside member 41, FIG. 5C is a side view of the outside member 41, FIG. 5D is a cross section cut along line c—c in FIG. 5B, and FIG. 5E is a cross section cut along line d—d in FIG. 5B.

FIG. 6 is a side view showing the drum pedal being transported.

DESCRIPTION OF A PREFERRED EMBODIMENT

Figure 1:
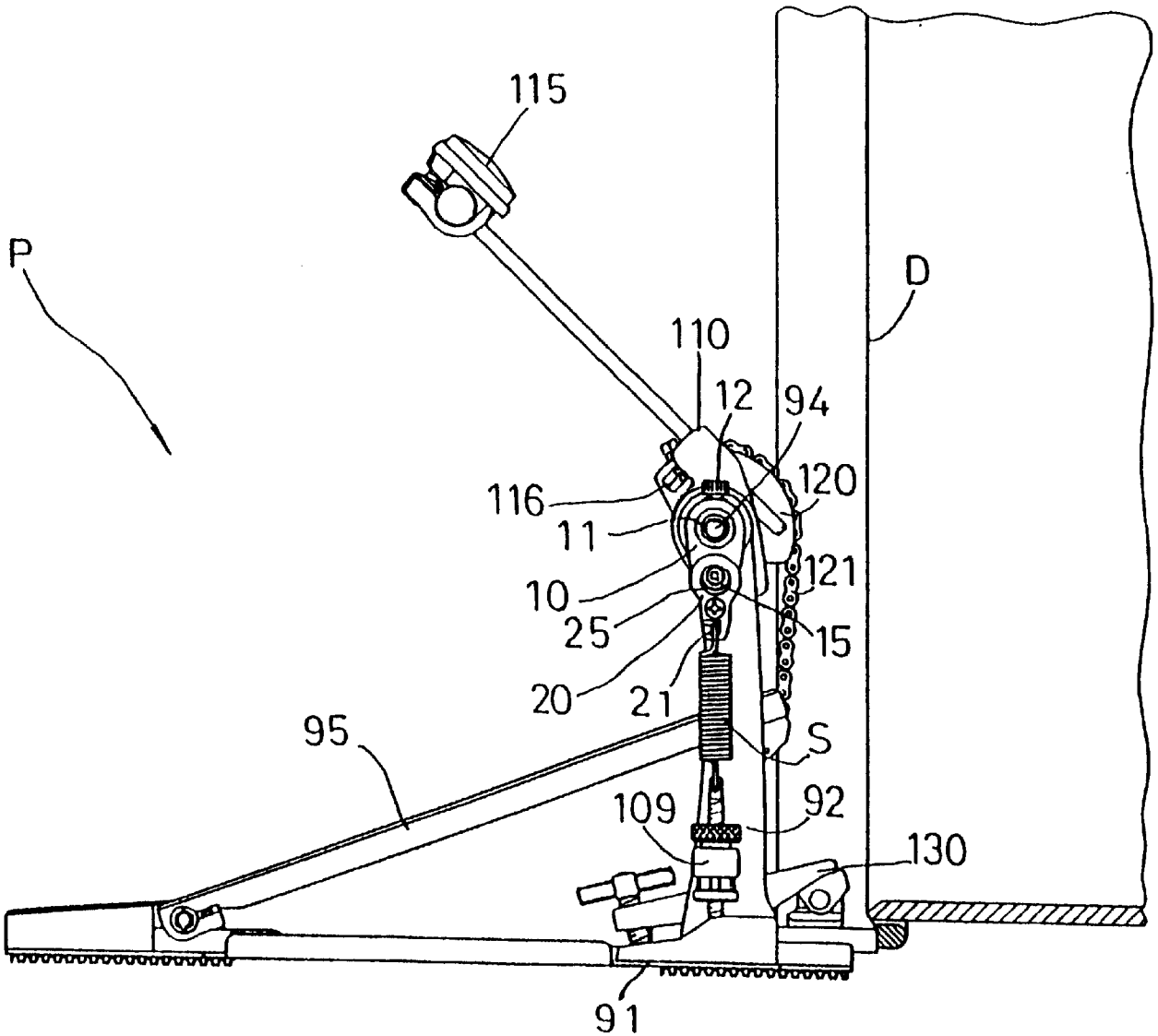
FIG. 1 is a side view of an entire drum pedal according to the invention.
Figure 9:
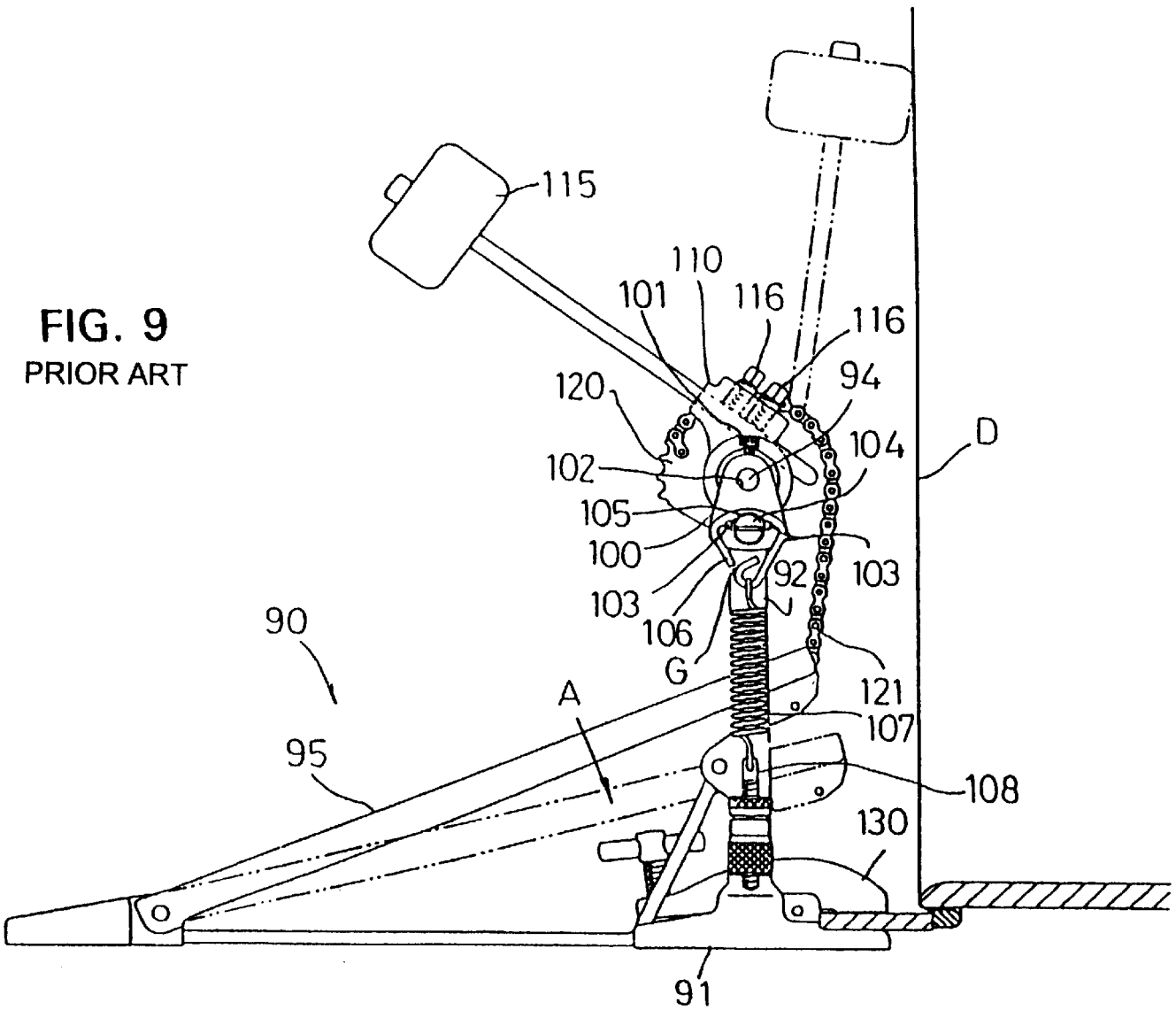
FIG. 9 PRIOR ART
FIG. 9 is a side view of an example of a drum pedal according to the prior art.
Figure 10:
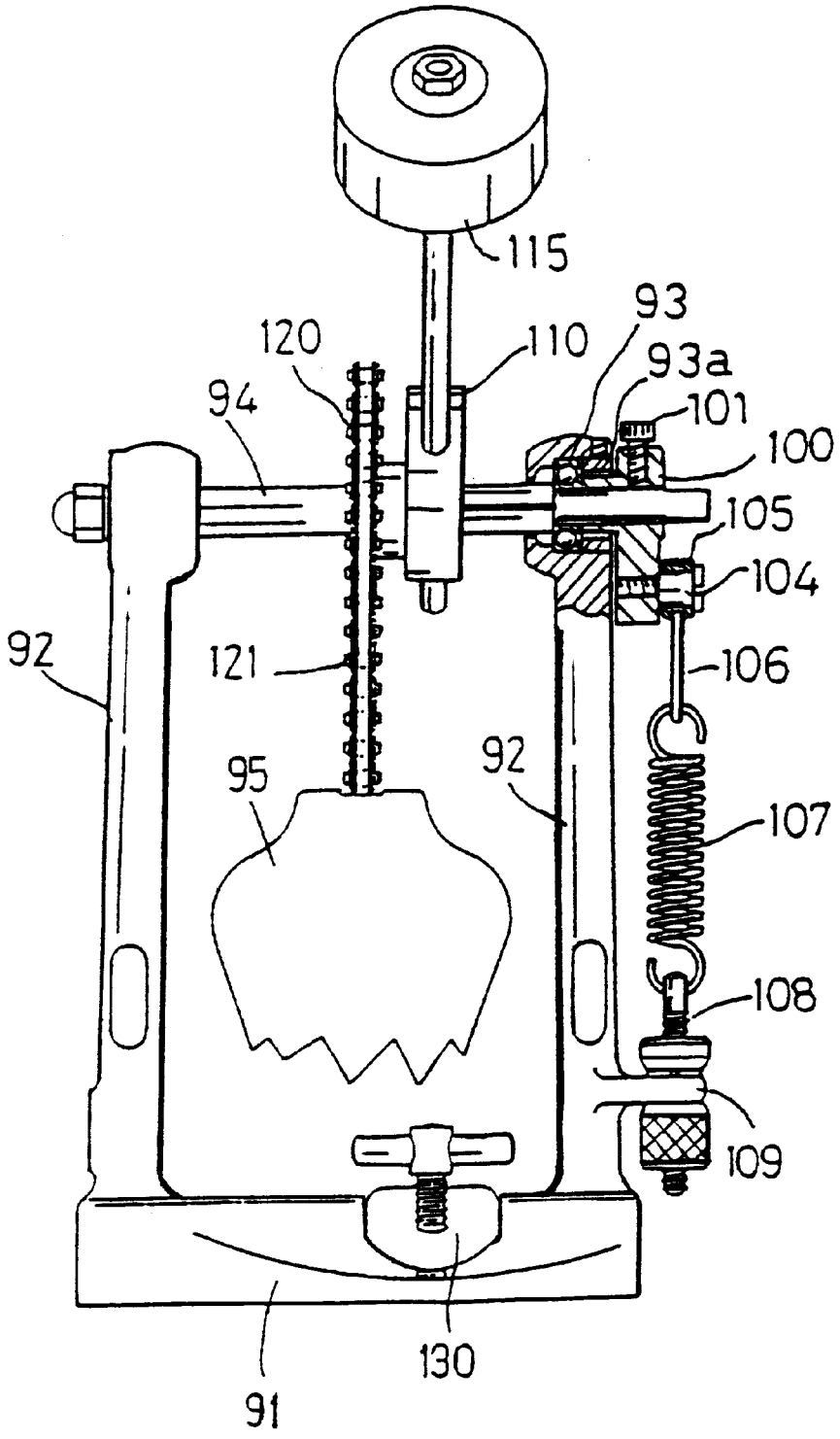
FIG. 10 PRIOR ART
FIG. 10 is a rear view of the pedal, with a part shown in cross section.
Figure 11:
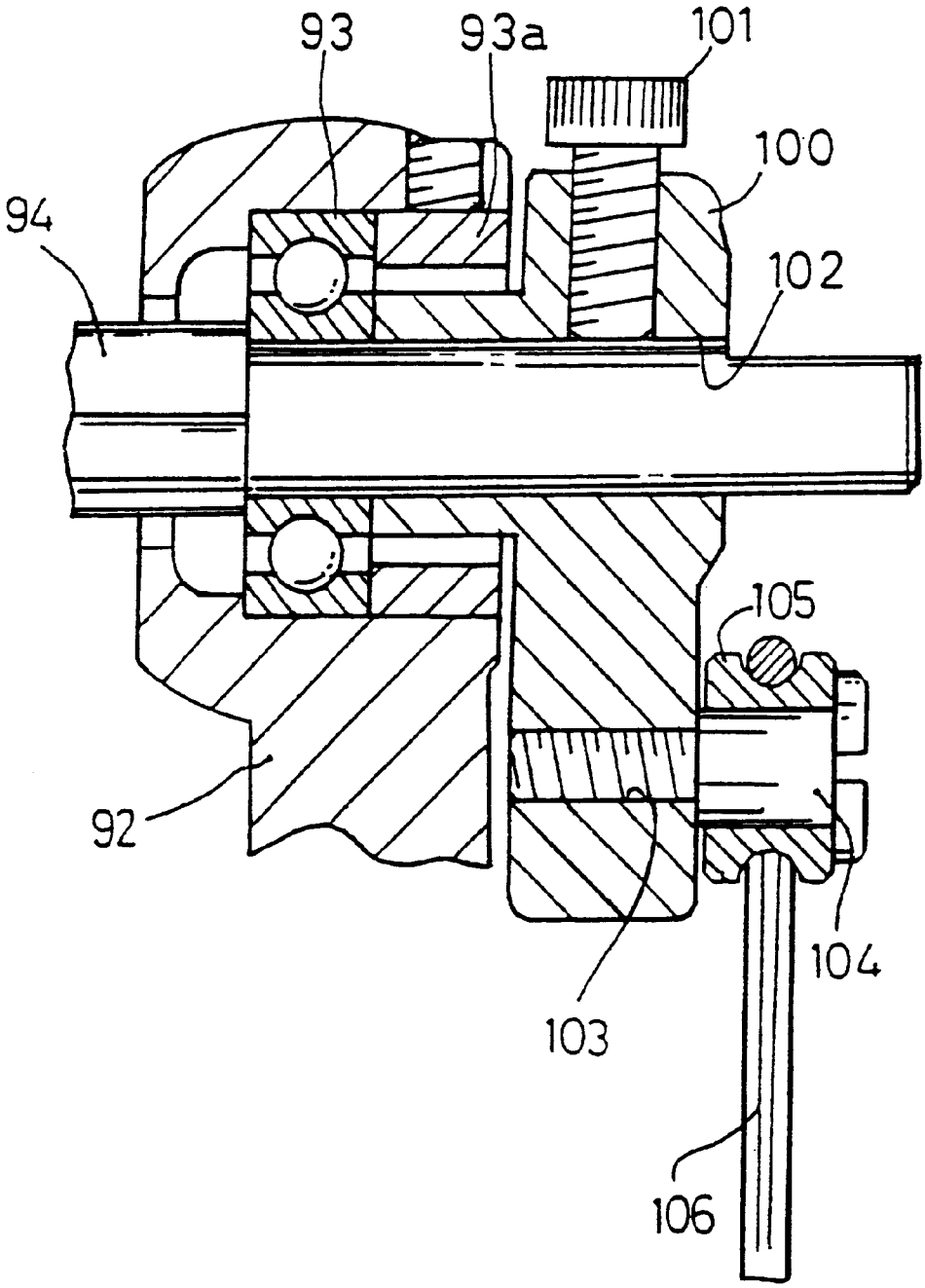
FIG. 11 PRIOR ART
FIG. 11 is an enlarged cross section showing its essential part.

The drum pedal P in FIG. 1 has the same structure as the prior art drum pedal 90 of FIGS. 9–11, except for the spring structure at the cam member 10. The same reference numbers are used without further explanation.

The beater rotary shaft 94 is freely rotatably held at the top of the supports 92. A spring S is provided between the cam 10 that has been installed at one end of the beater rotary shaft 94 and the lower part of the supports 92. The cam 10 has a shaft receiving hole 11 for insertion of the beater rotary shaft 94. A bolt 12 secures the cam 10 on the beater rotary shaft 94.

Figure 2:
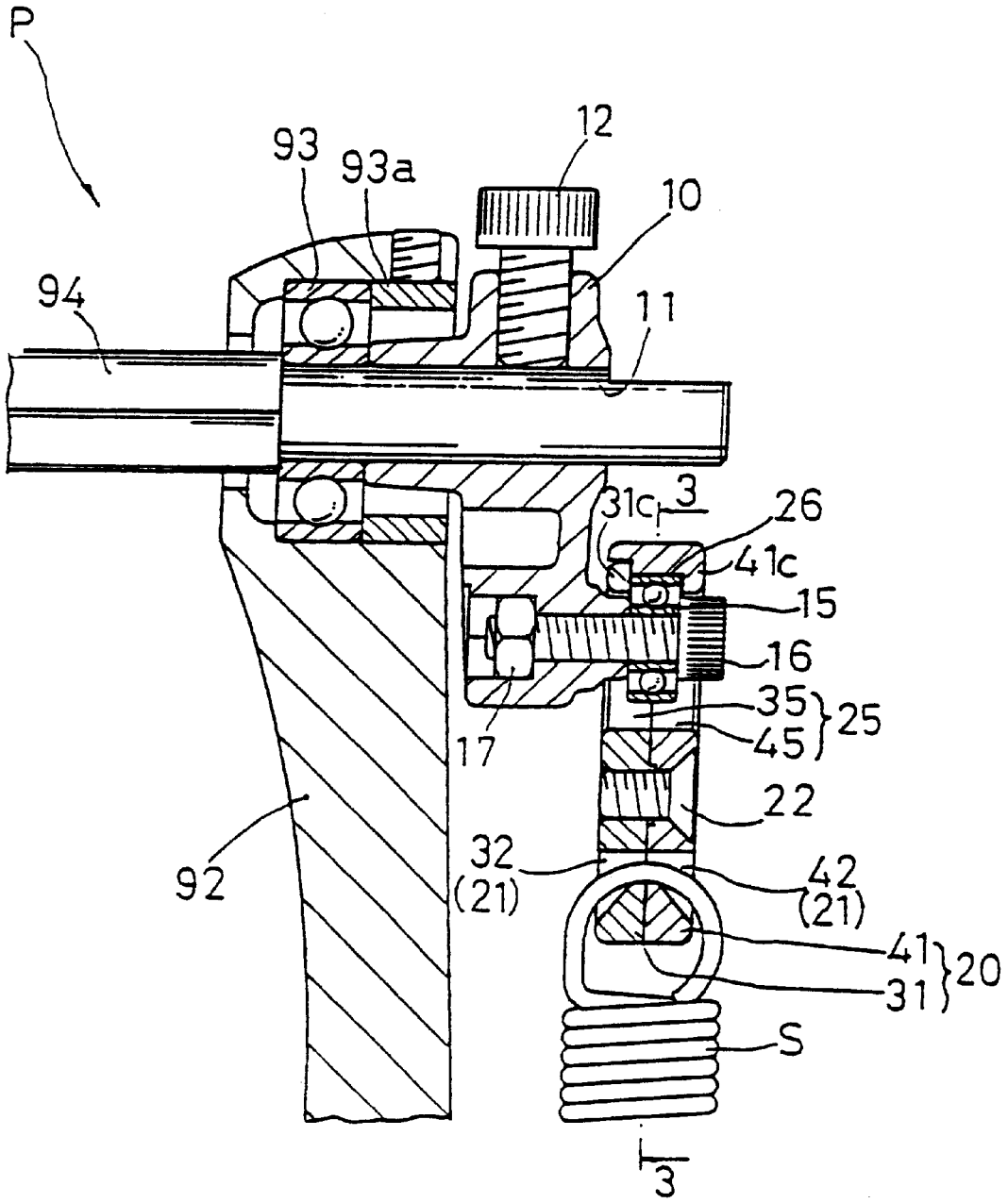
FIG. 2 is a cross section from the front showing essential parts of the drum pedal.

A bearing 15 protrudes laterally outside the lower part of the cam 10, as seen in FIGS. 2 and 3. A spring member 20 is provided freely detachably on the bearing 15. The bearing 15 is secured on the surface of the lower part of the cam member 10 through a tightening screw 16 tightened into a nut 17.

The spring member 20 has a spring support 21 at its lower end. It has a window 25 through it which is larger than the outside periphery of the bearing 15 and the member 20 has an engagement groove 26 at the top edge of the window 25. The top of the bearing 15 engages the engaging groove 26 of the spring member 20. The top of the spring S is hooked on the spring support 21.

The bottom end of the spring S is hooked to the lower bracket 109 which is laterally outside the support 92. The spring S is strong enough that it automatically restores the beater rotary shaft 94 that has been rotated by operation of the foot pedal 95, with the beater 115 automatically returning to its original position after being moved to beat the drum surface D.

Figure 13:
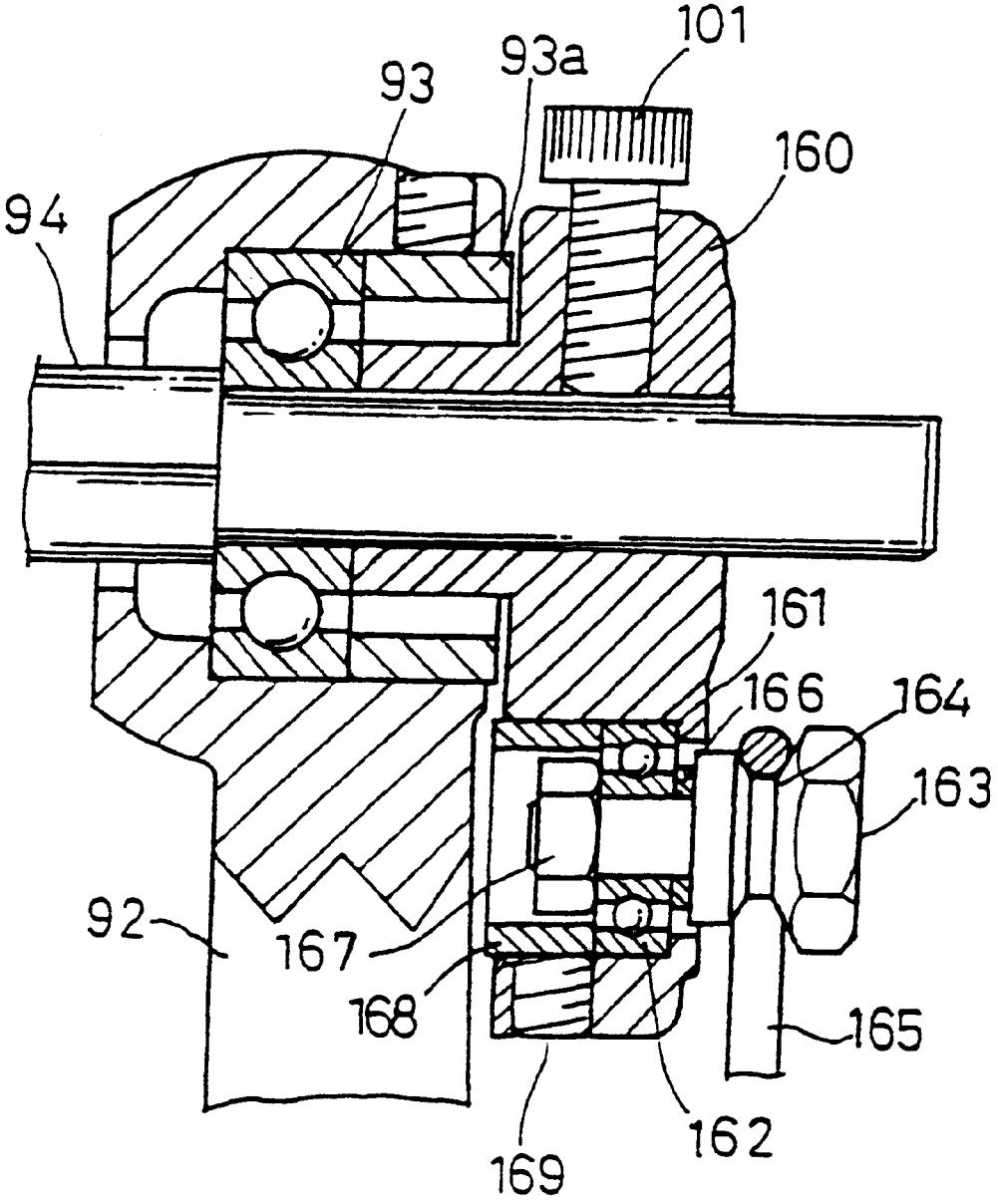
FIG. 13 PRIOR ART
FIG. 13 is a cross section showing the essential part of yet another example of a drum pedal.

Because the spring support 20 is provided on the cam 10 through the bearing 15, the friction produced when the spring support 20 rotates with respect to the cam 10 is reduced. The spring support 20 starts smooth rotation with respect to the cam 10, making rotation of the beater rotary shaft 94 smooth. Because the spring support 20 is provided on the bearing 15, moreover, it is possible to avoid application of an excess thrust load on the bearing 15 like that experienced with the prior art spring structure of FIG. 13.

Figure 7:
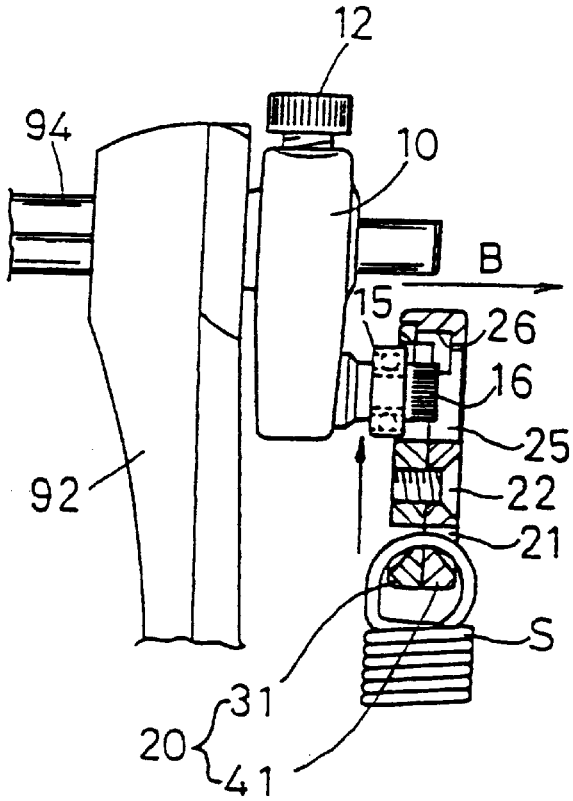
FIG. 7 is a partial cross section showing detachment of the spring member from the cam member.

The engagement between the engagement groove 26 of the spring support 20 and the top of the bearing 15 prevents the spring support 20 from falling from the bearing in the direction of arrow B in FIG. 7 at the time of assembly. Moreover, as the downward tension of the spring S works on the spring support 20 that engages the top of the bearing 15 in the engagement groove 26, there is no possibility that the spring support 20 will rise above the top of the bearing 15.

The spring support 20 is comprised of a combination of the laterally inside member 31 that opposes the support 92, with the laterally outside member 41 on its surface. Respective spring installation parts 32 and 42 having respective insertion openings 33 and 43 are formed at the sides 31*a* and 41*a* in an alternate fashion, as is shown in FIGS. 4 and 5 for the inside member 31 and the outside member 41, and the spring supporting member 21 is comprised of the spring installation parts 32 and 42.

The combination of the inside 31 and outside members 41 is achieved by the tightening screw 22 after the spring S has been mounted in the spring insertion openings 33 and 43 at the spring installation parts 32 and 42 in such a way that the top edge 41*c* of the outside member 41 may cover the top edge 31*c* of the inside member 31.

After the inside member 31 and outside member 41 are formed, the spring insertion openings 33 and 43 are blocked by the sides (where the spring insertion openings 33 and 43 are not formed) 31*b* and 41*b* of the inside member 31 and the outside member 41. This prevents the spring S at the spring support 21 of the spring member 20 from being disengaged from the spring support 21. The holes 34 and 44 define a female screw part on the inside member 31 and the outside member 41 respectively, for receiving the tightening screw 22 which joins them. The openings 35 and 45 are formed at the inside member 31 and the outside member 41 to define the window part 25.

Figure 4A:
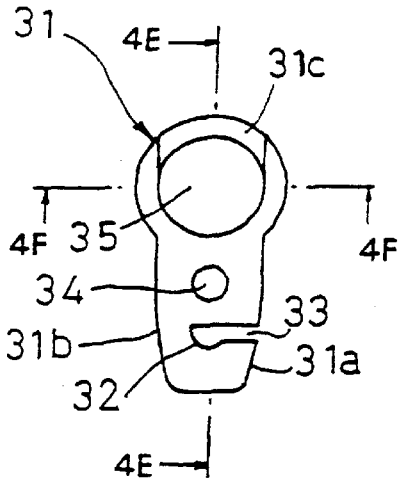
Figure 4B:
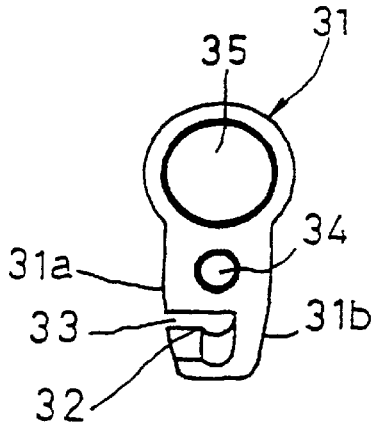
Figure 4C:
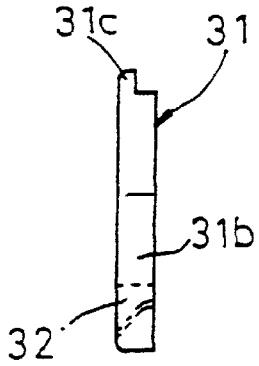
Figure 4D:
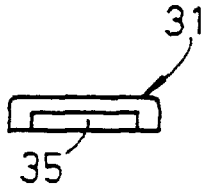
Figure 4E:
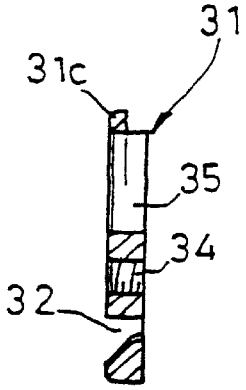
Figure 4F:
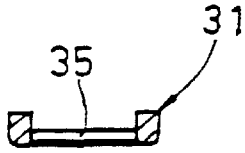
Figure 5A:
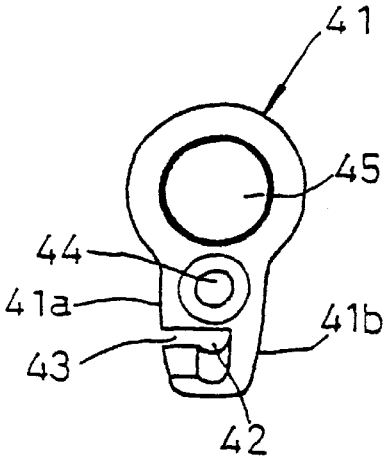
Figure 5B:
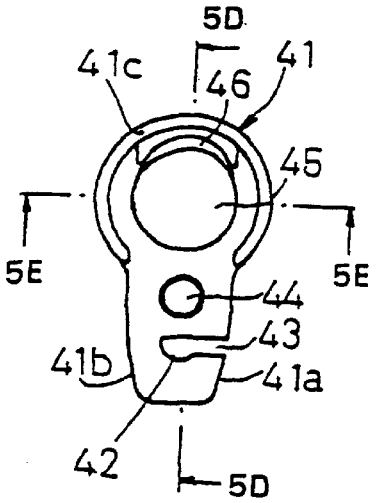
Figure 5C:
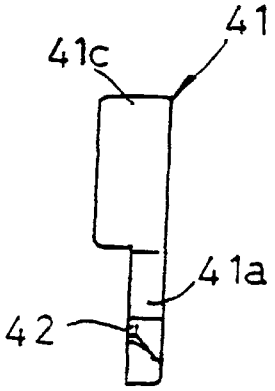
Figure 5D:
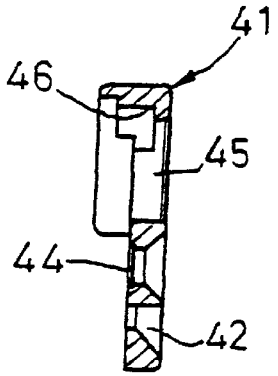
Figure 5E:
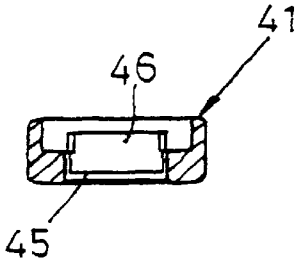

The engagement groove 26 which is engaged by the top of the bearing 15 is comprised of the groove 46 at the top of the opening 45 for the window of the outside member 41 as shown in the FIG. 5B and the side of the top 31*c* of the said inside member 31, as shown in FIGS. 4A and 4D. However, the design of the engagement groove 26 is not limited to what is described above. For example, a groove may be formed at the top of the opening 35 forming the window of the inside member 31, with the top part 41*c* of the outside member 41 being recessed so as to lie flush with portion 46, so that the engaging groove 26 is formed by the side of the top part 41*c* of the outside member 41 and the groove of the inside member 31 (not shown in the drawing) or both the inside member 31 and the outside member 41 are given a symmetrical shape, with mutually symmetrical grooves being formed at the top of the window opening 35 of the inside member 31 and the top of the window opening 45 of the outside member 41, thereby constituting an engaging groove 26.

As shown in FIG. 6, the drum pedal P is transported with the spring support 20 disengaged from the bearing 15 of the cam 10, the beater 115 and the beater member 110 being rotated rearward with the beater 115 positioned below the support 92 or the operating member 120.

Figure 12:
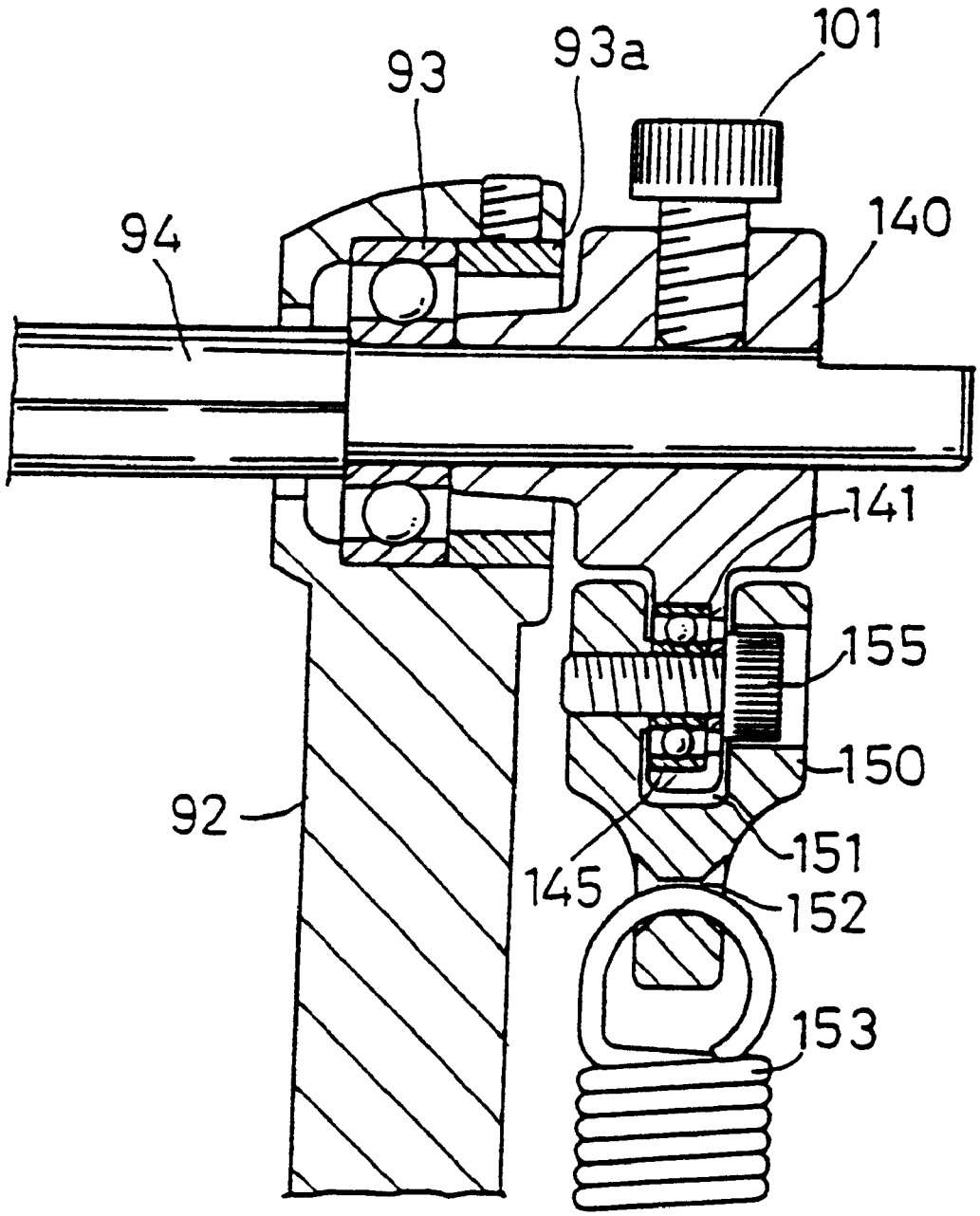
FIG. 12 PRIOR ART
FIG. 12 is a cross section showing the essential part of another prior art drum pedal.

If the drum pedal P is accommodated in a case C (shown by two dotted lines) for carrying, it will be highly convenient for transportation. In addition, this avoids the danger of damaging the drum pedal P. When it is carried, moreover, there is no need to dismantle the drum pedal P through loosening various screws, as was required in the spring structure of prior art FIG. 12, thereby preventing the various parts from being lost.

Figure 8:
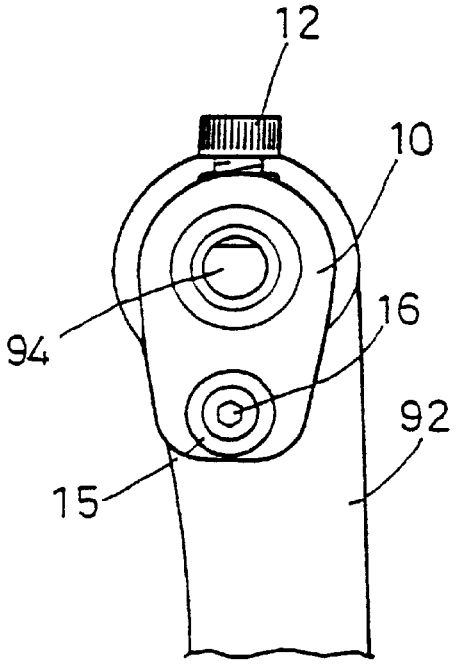
FIG. 8 is a side view showing the state when the spring member has been taken out of the cam member.

The spring support 20 can be dismantled from the bearing 15 by raising the spring support 20 by hand, followed by shifting the spring support 20 that has been raised in the direction indicated by an arrow mark B, as shown in FIGS. 7 and 8. Since the window 25 is formed larger than the outer periphery of the bearing 15, as described earlier, it is easy to move the spring member 20 with reference to the bearing 15 when the spring member 20 has been lifted.

In the spring structure for the drum pedal, the spring support is installed on the cam through a bearing, reducing the friction of the rotation of the spring support with respect to the cam, whereby the spring member is rotated smoothly with respect to the cam, thereby effecting smooth rotation of the beater rotary shaft.

Since the spring support is provided on the bearing, possible application of an excess thrust load on the bearing can be prevented. Moreover, the spring support can be easily detached from the bearing through the window part, and the drum pedal can be either carried or accommodated in the state where the beater is located below either the support or the operating member.

If the spring support is comprised of a combination of an inside member that opposes the support and an outside member on the side of its surface, and if the spring support includes a spring installation part having a spring insertion opening that has been formed on the side with an alternate arrangement of the inside member and the outside member, there is no possibility for disengagement from the spring support after assembly and, at the same time, installation of the spring on the spring support becomes easier.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A spring and spring support structure for rotating a shaft to a selected orientation comprising:

the spring support structure comprising a shaft support, a rotary shaft rotatably supported in the shaft support, a cam on the shaft which is rotatable with the shaft and which is operable to set the rotation orientation of the shaft;

a spring support rotatably supported to the cam;

a spring between the spring support on the cam and the shaft support such that the spring normally urges the cam and the shaft toward a first rotation orientation and such that rotation of the cam and the shaft off the first rotation orientation is opposed by the spring which urges the cam and the shaft toward the first rotation orientation;

the spring support having a window therein and the window having an engagement groove at and around the window and defining the window;

a bearing between the cam and the spring support for permitting relative rotation between them, the bearing being so positioned in the window that the spring draws on the spring support in a direction for urging the engagement groove of the spring support against the bearing so that the spring support is supported on the bearing, the window being sized larger than the outside periphery of the bearing in the window, whereby the bearing can be easily inserted into the window and can engage the engaging groove of the window and can be removed from the engagement groove and the window.

2. The spring and structure of claim 1, wherein the bearing is supported to protrude in the axial direction of the shaft to a lateral side of the cam and the spring is located correspondingly axially to the side of the cam.

3. The spring and structure of claim 1, wherein the spring support is comprised of an inside member toward the cam and an outside member away from the cam; each of the inside and outside members has an opening therethrough in which the spring is hooked;

the inside member including a hook leading into the respective opening and facing in one circumferential direction with respect to the shaft, and the outside member including a hook leading into the respective opening and facing in the opposite circumferential direction with respect to the shaft and the spring being in the openings of both of the inside and the outside members.

4. In combination, the spring structure of claim 1 and a drum pedal, wherein the drum pedal includes a pedal plate that is movable up and down, a connection between the pedal plate and the rotary shaft such that movement up and down of the pedal plate rotates the rotary shaft off the rotation orientation.

5. A spring and support structure for rotating a shaft to a selected orientation, the spring support structure comprising a rotary shaft support and a rotary shaft rotatably supported in the support, a cam on the shaft which is rotatable with the shaft so as to set the rotation orientation of the shaft;

a spring support rotatably supported to the cam;

a spring between the spring support on the cam and the shaft support such that the spring normally urges the cam and the shaft toward a first rotation orientation and such that rotation of the cam and the shaft off the first rotation orientation is opposed by the spring which urges the cam and the shaft toward the first rotation orientation;

the spring having an end that is hooked to the spring support;

the spring support is comprised of an inside member toward the cam and an outside member away from the cam; each of the inside and outside members has an opening therethrough in which the spring is hooked;

the inside member including a hook leading into the respective opening and facing in one circumferential direction with respect to the shaft, and the outside member including a hook leading into the respective opening and facing in the opposite circumferential direction with respect to the shaft and the spring being in the openings of both of the inside and the outside members.

6. In combination, the spring and structure of claim 5 and a drum pedal, wherein the drum pedal includes a pedal plate that is movable up and down, a connection between the pedal plate and the rotary shaft such that movement up and down of the pedal plate rotates the rotary shaft off the rotation orientation.

* * * * *